US005758234A

United States Patent [19]

Binder et al.

[11] Patent Number: 5,758,234

[45] Date of Patent: May 26, 1998

[54] APPARATUS AND METHOD FOR CONDITIONING A PHOTOCONDUCTOR

[75] Inventors: Andrew J. Binder; Quintin T. Phillips, both of Boise, Id.

[73] Assignee: Hewlett-Packard Company, Palo Alto, Calif.

[21] Appl. No.: 843,911

[22] Filed: Apr. 17, 1997

[51] Int. Cl.[6] ..... G03G 21/00

[52] U.S. Cl. ..... 399/127

[58] Field of Search ..... 399/71, 127, 156, 399/26, 411, 15, 181, 50, 2, 161

[56] References Cited

U.S. PATENT DOCUMENTS 4,304,486 12/1981 Cormier et al. ..... 399/55
5,072,258 12/1991 Harada ..... 399/50
5,255,057 10/1993 Stelter et al. ..... 399/285
5,361,123 11/1994 Yeh et al. ..... 399/50

*Primary Examiner*—S. Lee

[57] ABSTRACT

An apparatus and method for depositing toner on substantially the entire surface of the photoconductor to minimize print defects associated with surface contamination. This is accomplished by printing a background pattern along with the desired image. A light film of toner is deposited on the background areas of the photoconductor while a more dense film of toner is deposited on the image areas. The invention may be implemented by merging a background pattern, such as a uniform level of gray, with the print image data or by varying the charging conditions at photoconductive drum. In one implementation of the invention, a background pattern such as a uniform level of gray is printed by scanning the pattern onto the photoconductor as part of the imaging light exposure process. In a second implementation of the invention, the background gray is printed by adjusting the charging potential applied to photoconductor and/or the various roller bias voltages.

19 Claims, 4 Drawing Sheets

APPARATUS AND METHOD FOR CONDITIONING A PHOTOCONDUCTOR

FIELD OF THE INVENTION

The invention relates generally to electrophotographic printing and, more particularly, to an apparatus and method for depositing a light film of toner uniformly across the surface of the photoconductor to minimize print defects associated with surface contamination.

BACKGROUND OF THE INVENTION

Electrophotographic printing involves applying a uniform surface charge to a photoconductor and exposing the photoconductor to imaging light that discharges the photoconductor in select areas to define a latent electrostatic image on the photoconductor. The latent image is developed by depositing toner on the surface of the photoconductor. The toner adheres to the imaged areas of the photoconductor to form a developed image that is transferred to paper or another imaging substrate. The optical density of the toner deposited on the photoconductor, and therefore of the image transferred to the paper, is a function of the charge difference or "contrast" between the imaged areas and the un-imaged areas on the photoconductor. Thus, the degree of contrast depends on the difference between the surface charge initially applied to the photoconductor and the charge remaining on the areas discharged by the imaging light.

In the past, the electrophotographic printing process benefited from a light film of toner in undeveloped areas that was deposited on the surface of the photoconductor. The inability to achieve a narrow toner charge to mass ratio distribution resulted, in some cases, in small amounts of toner attracted to and deposited in the undeveloped background areas on the photoconductor. For organic photoconductors in particular, it was found to be very difficult to completely avoid depositing small amounts of toner in undeveloped areas. This film of toner assisted in conditioning the photoconductor by inhibiting surface contamination and by removing surface contaminants. Unfortunately, this film of toner also interfered with print quality by causing a print quality defect commonly known as "background gray."

Recent developments in electrophotographic printing processes, equipment and materials, particularly better toners, have substantially eliminated the toner film associated with background gray. The benefits to print quality gained by eliminating the toner film, however, have been offset somewhat by print defects associated with increased surface contamination of the photoconductor when the system is operated in a contaminated environment. Reducing the toner film to minimize background gray means less toner is available to condition the photoconductor. Operation of the printing system in aggressive or less than ideal environments has resulted in print defects associated with surface contamination of the photoconductor. Several attempts have been made to condition the photoconductor by adding abrasives to the toner to increase the scrubbing action of the toner on the surface of the photoconductor. Adding abrasives has reduced surface contamination related defects by as much as 20%. Adding still more abrasives, however, has been shown to degrade other print quality factors. Also, adding abrasives decreases the life of the photoconductor and requires multiple products to support the printing system.

SUMMARY OF THE INVENTION

The present invention is directed to an apparatus and method for depositing toner on substantially the entire surface of the photoconductor to minimize print defects associated with surface contamination. This is accomplished by printing a background pattern along with the desired image. A light film of toner is deposited on the background areas of the photoconductor while a more dense film of toner is deposited on the image areas. The invention may be implemented by merging a background pattern, such as a uniform level of gray, with the print image data or by varying the charging conditions at photoconductive drum. In one implementation of the invention, a background pattern such as a uniform level of gray is printed by scanning the pattern onto the photoconductor as part of the imaging light exposure process. In a second implementation of the invention, the background gray is printed by adjusting the charging potential applied to photoconductor and/or the various roller bias voltages.

Selectively adding toner helps condition and thereby prolong the usable life of the photoconductor. In some cases, the conditioning takes the form of inhibiting surface contamination and scrubbing away surface contaminants. It has been observed in tests on a dry toner laser printer system that adding a conditioning level of 10% background gray increases the life of a photoconductor by up to four times. So far as applicants are aware, this four fold increase in yield is much greater than that attained by any other method.

DETAILED DESCRIPTION OF THE INVENTION

Figure 1:
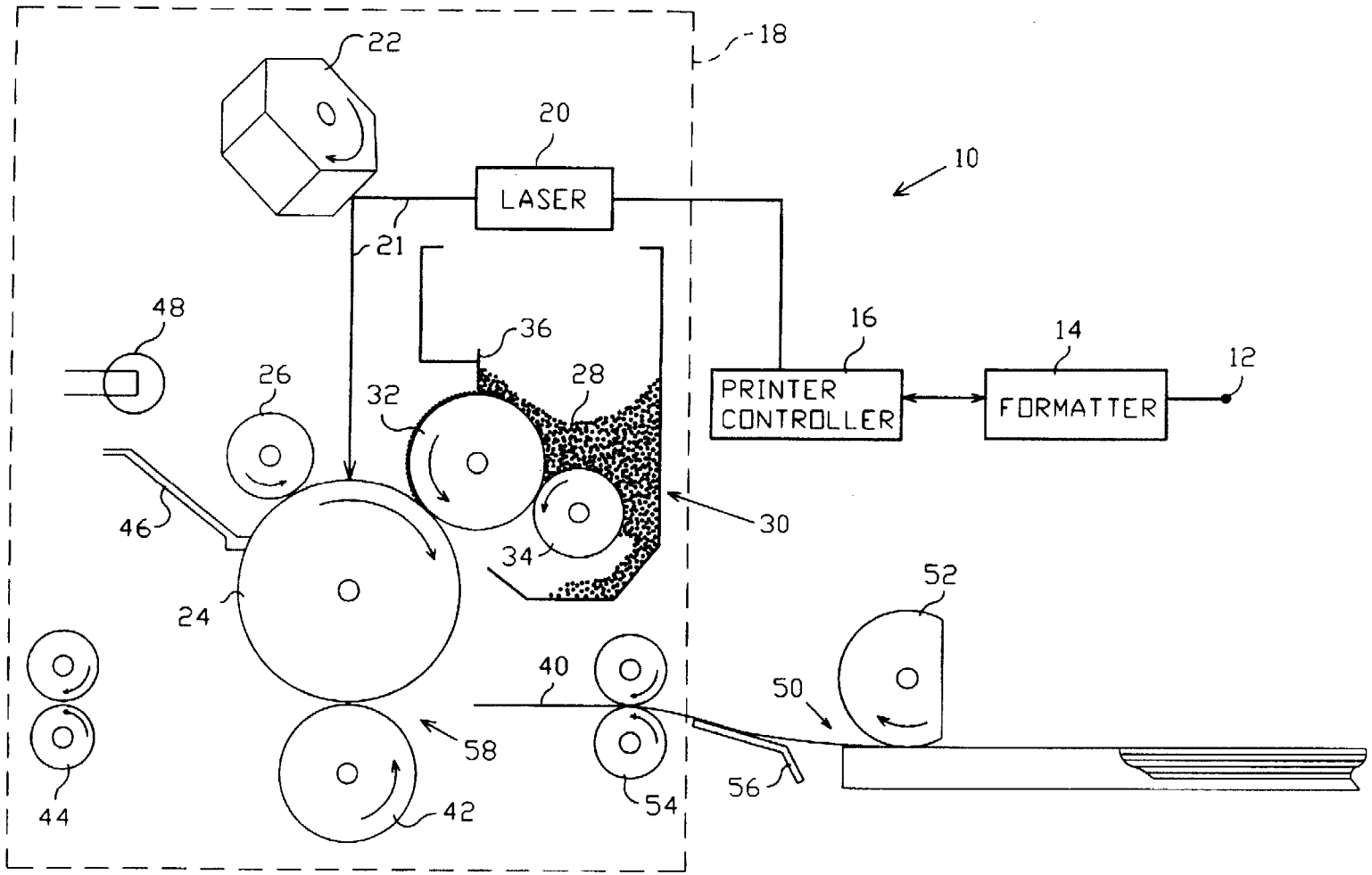
FIG. 1 is a schematic elevation view of a laser printer.

FIG. 1 schematically depicts the basic components of a laser printer, designated by reference number 10, incorporating the photoconductor conditioning system of the present invention. This conditioning system is equally well suited for use in a wide variety of electrophotographic printing devices, including printers, copiers and facsimile machines, and is not limited to the laser printer embodiment shown in the figures and described below. In as much as the art of electrophotographic laser printing is well known, the basic components of laser printer 10 are shown schematically and their operation described only briefly.

In general, and referring to FIG. 1, a computer transmits data representing a print image to input port 12 of printer 10. This data is analyzed in formatter 14, which typically consists of a microprocessor and related programmable memory and page buffer. Formatter 14 formulates and stores an electronic representation of each page to be printed. Once a page has been formatted, it is transmitted to the page buffer. The page buffer breaks the electronic page into a series of lines or "strips" one dot wide. This strip of data is then sent to a printer controller 16. Controller 16, which also includes a microprocessor and related programmable memory, directs and manages the operations of print engine 18. Each strip of data is used to modulate the light beam produced by laser 20 such that the beam of light "carries" the data. The light beam is reflected off a multifaceted spinning mirror 22. As each facet of mirror 22 spins through the light beam, if reflects or "scans" the beam across the surface of a photoconductive drum 24. Photoconductive drum 24 rotates about a motor-driven shaft such that it advances just enough that each successive scan of the light beam is recorded on drum 24 immediately after the previous scan. In this manner, each strip of data from the page buffer is recorded on photoconductive drum 24 as a line one after the other to reproduce the page on the drum.

Charging roller 26 charges photoconductive drum 24 to a relatively high substantially uniform negative (or positive) polarity at its surface. A corona type charge generating device may be used in place of the charging roller. For discharge area development (DAD), such as that used in laser printers, the areas on the fully charged drum 24 exposed to light beam 21 from laser 20 represent the desired print image. The exposed areas of drum 24 are partially or fully discharged, depending on the intensity of light beam 21 and the duration of exposure. The unexposed background areas of drum 24 remain fully charged. This process creates a latent electrostatic image on conductive drum 24. For charge area development (CAD), such as that used in photocopiers, the background areas on the fully drum 24 are exposed to the light. The unexposed areas of the drum represent the desired print image. For DAD development processes, the toner particles are charged to the same polarity as the photoconductive drum, as described below. For CAD development processes, the toner particles are charged to a polarity opposite that of the photoconductive drum.

Toner particles 28 are triboelectrically charged in toner application unit 30 to the same negative (or positive) polarity as photoconductive drum 24. Toner application unit 30 includes a developer roller 32 positioned adjacent to a charge applicator roller 34 and metering blade 36. Developer roller 32 is electrically biased to repel the charged toner particles 28 to the discharged image areas on photoconductive drum 24. The fully charged background areas also repel toner particles 28 onto the discharged image areas. In this way, the toner is transferred to photoconductive drum 24 to form the developed toner images 38 shown in FIG. 3.

Toner images 38 are transferred from photoconductive drum 24 onto paper 40 as paper 40 passes between drum 24 and transfer roller 42. Transfer roller 42 is electrically biased to impart a relatively strong positive charge to the back side of paper 42 as it passes by drum 24. The positive charge attracts the negatively charged toner and pulls it from drum 24 to form the image on paper 42. The toner is then fused to paper 40 as the paper passes between heated fusing rollers 44. Drum 24 is cleaned of excess toner with cleaning blade 46. Each sheet of paper 40 is pulled into the pick/feed area 50 by feed roller 52. As the leading edge of paper 40 moves through pick/feed area 50, it is engaged between a pair of registration rollers 54. Ramp 56 helps guide paper 40 into registration rollers 54. Registration rollers 54 advance paper 40 fully into image area 58 until it is engaged between drum 24 and transfer roller 42 and toner is applied as described above.

Figure 4:
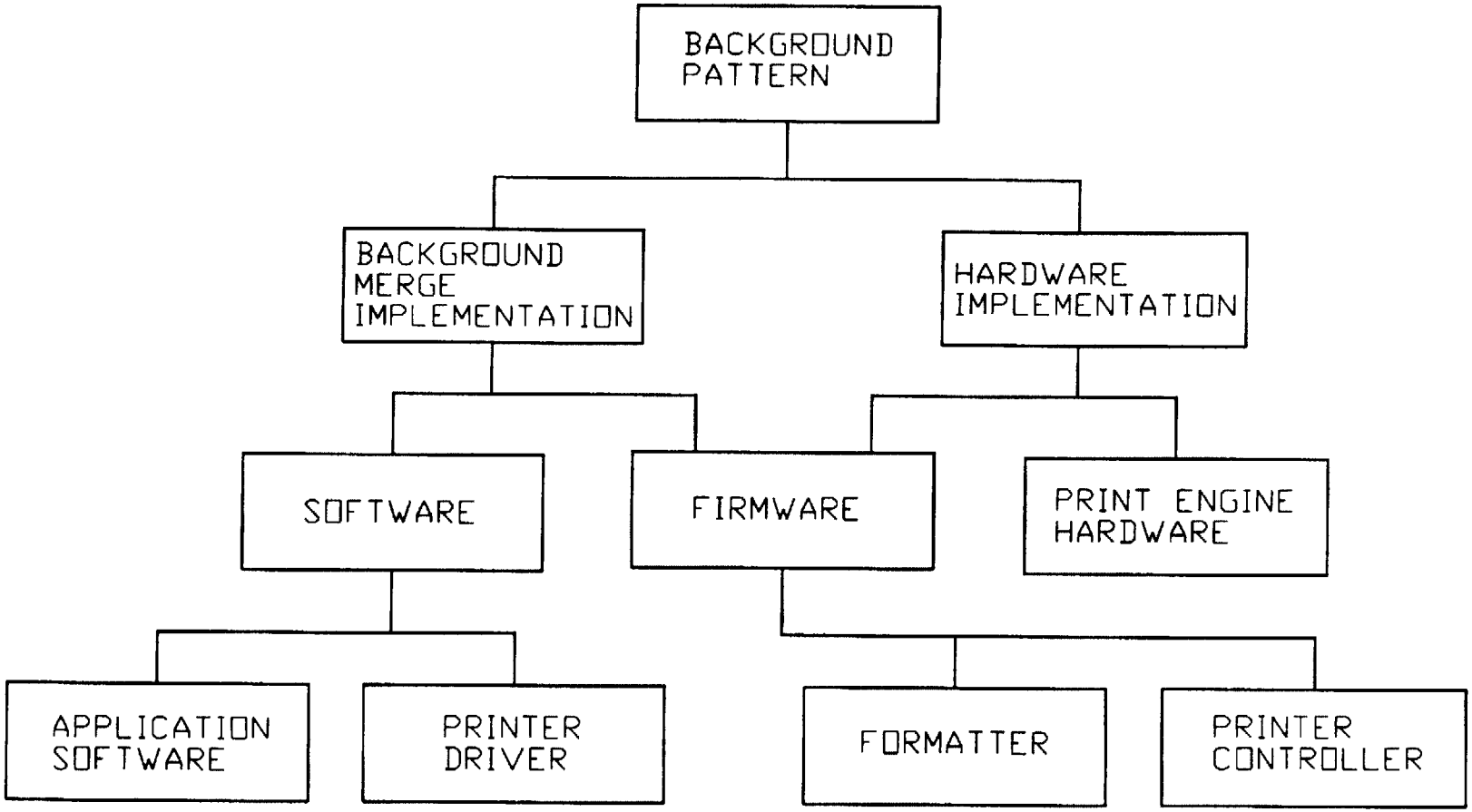
FIG. 4 is a chart illustrating the relationship between various options for implementing the invention.

The invention may be implemented by merging a background pattern, such as a uniform level of gray, with the print image data (the "background merge" implementation) or by varying the charging conditions at photoconductive drum 24 (the "hardware" implementation). FIG. 4 illustrates the relationship between the background merge and hardware implementations of the invention.

The background merge implementation may be accomplished through application software such as a printer life enhancement utility, through printer driver software with a background level selection feature, or through the formatter 14 or printer controller 16 firmware. The background merge is implemented using essentially the same methods in both software and firmware. One such method logically ORs a select background pattern mask with the print image data stream on a bitwise basis. For example, assuming a scan line segment having pixels represented by the bit stream 0111100000011110 and a 10% background pattern bit mask represented by the bit stream 100000000100000 (one active pixel per ten bits), the resulting print data stream is 1111100000111110. Advantageously, the background pattern is shifted over time to apply the background pattern, and therefore distribute the toner, more evenly over the entire surface of photoconductive drum 24. To accomplish this, the background pattern bit mask is shifted right or left an odd number of increments on successive print jobs, within the same print job, or on some other predetermined or random interval so that the print data stream segment scanned onto the same area of drum 24 shifts the background pattern to a new location and, correspondingly, deposits toner particles 28 at different locations on photoconductive drum 24.

Figure 2:
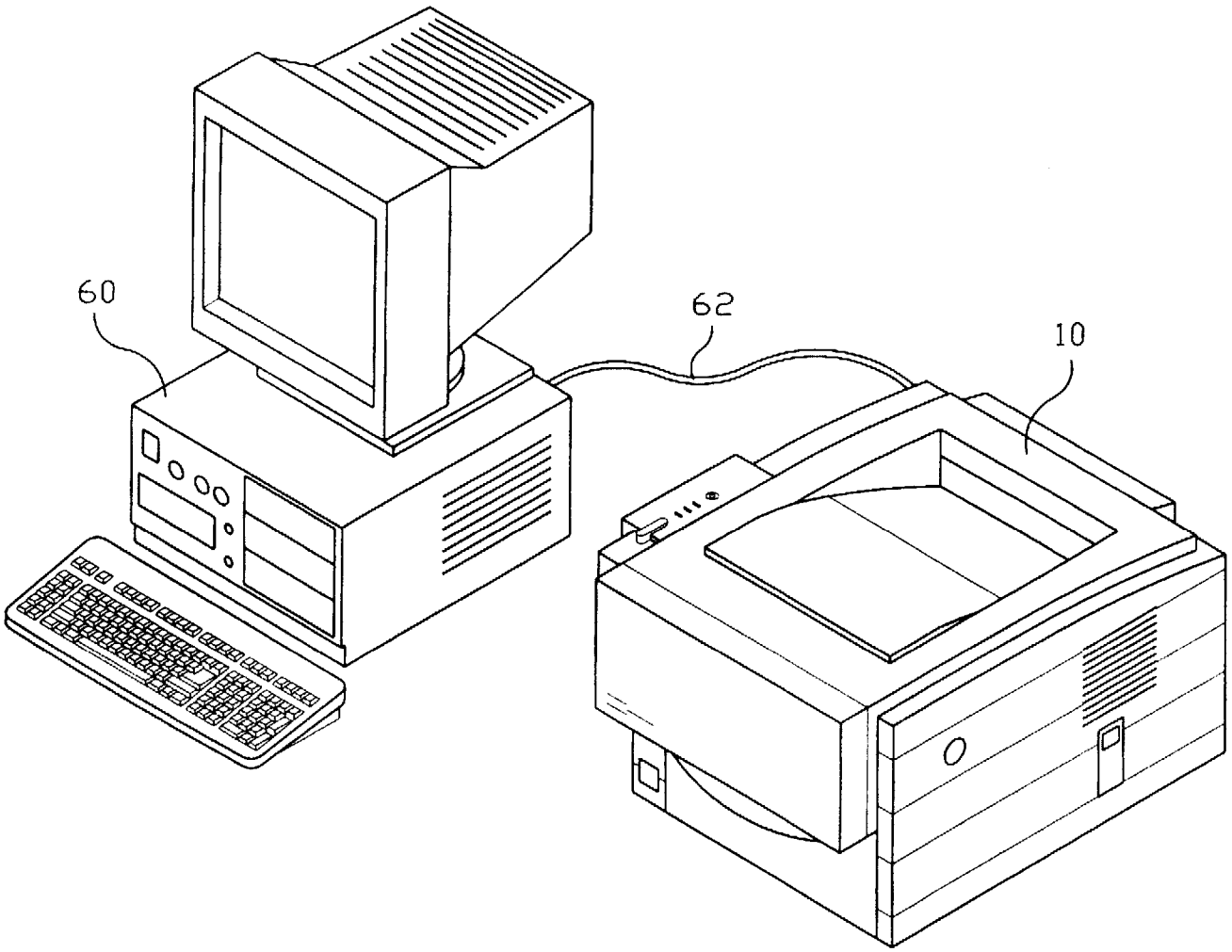
FIG. 2 is a schematic view showing a personal computer as the source document generator for the laser printer of FIG. 1.

In one software implementation illustrated in FIG. 2, a personal computer 60 is the host device connected to printer 10 through connector 62. Connector 62 represents generally any of the various connecting devices that enable communication between computer 60 and printer 10, including parallel, serial and network cable connections or telecommunication, infrared and radio frequency links. Computer 60 includes document generating software and its associated printer driver. Collectively, these define one of several possible source documents generators. The source document generator produces an electronic representation of the document to be printed and provides this data as an input to printer 10 at input port 12. The data input includes the desired background pattern which is merged with the text and/or graphical print image and transmitted to formatter 14 and on to printer controller 16 and print engine 18.

Although the background pattern merge implementation may be carried out in either the host device software or in the printer firmware, the printer firmware is preferred. Implementing the merge in the printer firmware reduces the load on the host processor, thereby reducing the time away from user applications. Also, implementing the merge in the printer firmware reduces the bandwidth used to transmit a print job to the printer, thereby reducing the time to transmit the print job and the load on the communications network between the host device and the printer. The invention is readily implemented in existing printers by substituting a modified read only memory (ROM) for the existing ROM in which the firmware resides in either of the formatter 14 or printer controller 16.

Figure 3:
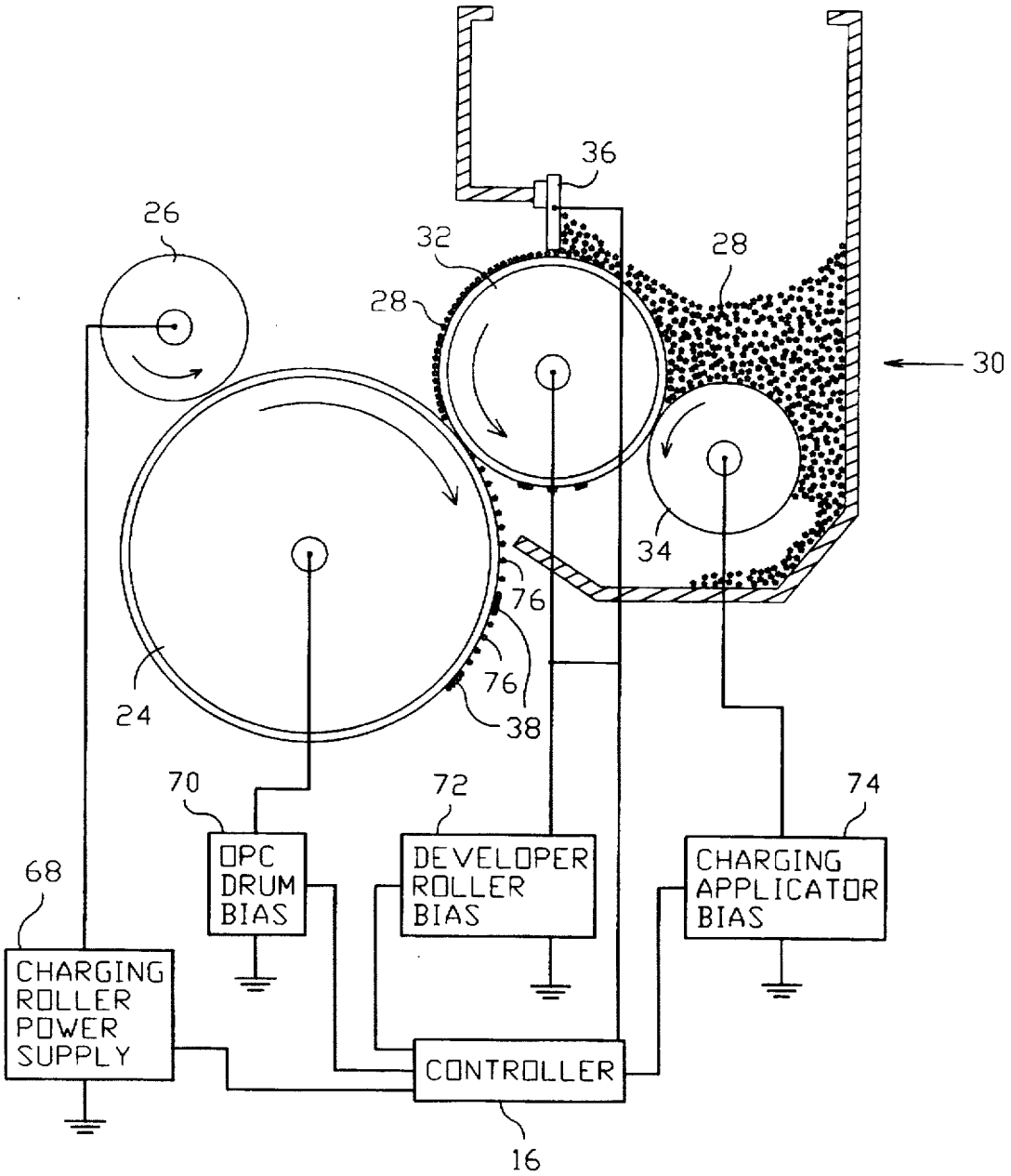
FIG. 3 is a detail elevation view of the toner applicator unit and photoconductive drum components of the print engine for the laser printer of FIG. 1.

In the hardware implementation of the invention, the background pattern is developed by adjusting the charging potential applied to photoconductive drum 24 and/or the various bias voltages. Referring to FIG. 3, charging roller power supply 68 and the photoconductive drum, developer roller and charging applicator roller bias power supplies 70, 72 and 74 are all operatively coupled to and controlled by print controller 16. The desired level of background gray may be printed by reducing the initial charge applied to photoconductive drum 24 through charging roller 26 below that ordinarily applied to maximize contrast between the print image and the background. Selectively undercharging photoconductive drum 24 will lower the degree to which the background areas repel toner particles 28. As a result, a limited number of toner particles will be deposited onto the now undercharged background areas on photoconductive drum 24, as indicated by reference number 76. A similar result may be achieved by varying the bias voltages applied to photoconductive drum 24 or developer roller 28, alone or in combination with adjustments to the initial charge applied to drum 24. The relative power supply voltages 68 and 70–74 are set by controller 16 to achieve the desired level of background gray according to a predetermined algorithm embodied in the firmware of formatter 14 or controller 16. Alternatively, the desired power supply voltages 68 and 70–74 could be pre-set and hard wired into the print engine components.

Preferably, the background gray is applied fully across the printed page to uniformly coat photoconductive drum 24 with a thin film of toner. Most preferably, the level of background gray will not exceed 15%. Background gray levels between 1% and 15% vary in effect on the printed page from not noticeable to light gray. Although the greatest conditioning benefits are obtained at the higher levels of background gray, it is believed that increases in yield can be realized at levels as low as 4%. The background pattern need not be printed on every page of every print job. The level and frequency of the background pattern may be varied as necessary to achieve the desired level of conditioning, consistent with the operating environment of the printer. The background can be selected automatically according to a predetermined time sequence and pattern distribution or through a sensing device, or it can be selected manually by the user.

While the present invention has been shown and described with reference to the foregoing preferred embodiment, other forms and details may be made thereto without departing from the spirit and scope of the invention as defined in the following claims.

What is claimed is:

1. A method for conditioning a photoconductor in an electrophotographic printing device, comprising the steps of:

generating a background pattern on the photoconductor;

generating a print image on the photoconductor; and simultaneously printing the background pattern and the print image.

2. A method according to claim 1, wherein the steps of generating a background pattern and a print image comprise forming a variable density film of toner on substantially an entire surface of the photoconductor, the film of toner more dense at locations of the print image and less dense at locations of only the background pattern.

3. A method for conditioning a photoconductor in an electrophotographic image forming device, comprising the steps of:

receiving first electronic data at an input to the image forming device, the first data representing a print image;

receiving second electronic data in the image forming device, the second data representing a background pattern; and printing a document according to the first and second data.

4. A method according to claim 3, wherein the second data representing the background pattern is generated external to the image forming device and received at an input to the device.

5. A method according to claim 3, wherein the second data representing the background pattern is generated within the image forming device.

6. A method according to claim 3, further comprising the step of merging the first and second data.

7. A method according to claim 6, wherein the data are merged external to the image forming device and received by the device as a unitary data stream.

8. A method according to claim 6, wherein the data are merged in the image forming device.

9. A method according to claim 3, wherein the second data representing a background pattern is generated in response to user interaction at a control panel of the image forming device.

10. A method according to claim 3, wherein the second data representing a background pattern is generated automatically within the image forming device.

11. A method according to claim 3, wherein the background pattern comprises a uniform level of gray.

12. A method according to claim 3, wherein the background pattern comprises a uniform level of gray not exceeding 15% density.

13. A method for conditioning a photoconductor in an electrophotographic image forming device wherein the image is developed on discharged areas of a photoconductor, comprising the steps of:

uniformly undercharging a photoconductor in the image forming device according to a desired background pattern;

selectively discharging portions of the charged photoconductor according to a desired print image; and then depositing toner on to substantially an entire surface of the photoconductor to form a light film of toner on the undercharged background areas of the photoconductor and a dense film of toner on the discharged areas of the photoconductor.

14. An electrophotographic image forming device, comprising:

a print engine including a photoconductor;

a printer controller operatively coupled to the print engine; and the printer controller having a microprocessor and related programmable memory configured to transmit electronic data to the print engine to deposit at least a thin film of toner on to substantially an entire surface of the photoconductor.

15. A device according to claim 14, further comprising a formatter, the printer controller operatively coupled between the formatter and the print engine, and the formatter having a microprocessor and related programmable memory configured to generate and transmit to the printer controller electronic data representing a desired background pattern.

16. A device according to claim 15, wherein the formatter and the printer controller are discrete components of the image forming device.

17. A device according to claim 15, wherein the formatter and the printer controller form one integral component of the image forming device.

18. A device according to claim 14, wherein the print engine further comprises a charging member electrically coupled to the photoconductor and responsive to the printer controller to uniformly undercharge the photoconductor according to a desired background pattern.

19. A device according to claim 18, wherein the print engine further comprises a source of light communicating with the photoconductor and responsive to the printer controller to selectively discharge portions of the photoconductor according to a desired print image.

* * * * *